US010660442B2

(12) United States Patent
Miles

(10) Patent No.: US 10,660,442 B2
(45) Date of Patent: May 26, 2020

(54) MEDITATION SEAT AND PAD

(71) Applicant: Calyx Cushions LLC, Madison, WI (US)

(72) Inventor: Harry Miles, Madison, WI (US)

(73) Assignee: Calyx Cushions LLC, Madison, WI (US)

( * ) Notice: Subject to any disclaimer, the term of this patent is extended or adjusted under 35 U.S.C. 154(b) by 0 days.

(21) Appl. No.: 16/583,583

(22) Filed: Sep. 26, 2019

(65) Prior Publication Data

US 2020/0093269 A1 Mar. 26, 2020

Related U.S. Application Data

(60) Provisional application No. 62/736,849, filed on Sep. 26, 2018.

(51) Int. Cl.

| | |
|---|---|
| ***A47C 3/16*** | (2006.01) |
| ***A47C 16/04*** | (2006.01) |
| ***A47C 15/00*** | (2006.01) |
| *A45C 9/00* | (2006.01) |

(52) U.S. Cl.

CPC ..... *A47C 3/16* (2013.01); *A47C 15/004* (2013.01); *A47C 16/04* (2013.01); *A45C 2009/002* (2013.01)

(58) Field of Classification Search

CPC ..... A47C 3/16; A47C 15/004; A47C 16/04; A45C 2009/002

USPC ..... 297/17

See application file for complete search history.

(56) References Cited

U.S. PATENT DOCUMENTS

| | | | | |
|---|---|---|---|---|
| 4,826,242 | A * | 5/1989 | Trethewey | A47C 7/021 2/69 |
| 5,042,875 | A * | 8/1991 | Biggs, Sr. | A47C 1/16 297/188.01 |
| 5,137,333 | A * | 8/1992 | Chee | A47C 7/029 297/452.21 |
| 5,944,379 | A * | 8/1999 | Yates | A47C 7/021 297/129 |
| 6,270,155 | B1 * | 8/2001 | Rashid | A47C 3/16 297/1 |
| 6,502,902 | B1 * | 1/2003 | Romero | A47C 1/16 297/352 |
| 7,472,960 | B1 * | 1/2009 | Kuehn | A47C 3/16 248/174 |
| 2005/0200176 | A1 * | 9/2005 | Conner | A47C 1/12 297/248 |
| 2007/0129226 | A1 * | 6/2007 | Leavitt | A63B 23/0458 482/129 |
| 2009/0079244 | A1 * | 3/2009 | Kelleher | A47C 1/16 297/257 |
| 2010/0301639 | A1 * | 12/2010 | McPheeters | A61G 9/003 297/118 |
| 2014/0103688 | A1 * | 4/2014 | Wilson | A47C 1/03211 297/337 |
| 2015/0173515 | A1 * | 6/2015 | Freedman | A47C 7/024 297/314 |
| 2018/0201162 | A1 * | 7/2018 | Sasaki | B60N 2/1695 |

* cited by examiner

*Primary Examiner* — Mark R Wendell

(74) *Attorney, Agent, or Firm* — Quarles & Brady LLP

(57) ABSTRACT

Disclosed herein is a meditation apparatus comprising a meditation seat and articulated pad that is lightweight, compact, and easy to transport that is suitable for indoor and outdoor use, wherein the articulated pad is pivotally connected to the seat.

31 Claims, 12 Drawing Sheets

MEDITATION SEAT AND PAD

CROSS-REFERENCE TO RELATED APPLICATIONS

This application claims benefit of priority to U.S. Provisional Application 62/736,849, filed Sep. 26, 2018, the contents of which is incorporated by reference in its entirety.

BACKGROUND

Practitioners of meditation may meditate in a variety of environments, including indoors or outdoors, in group settings or individual settings, and in their homes or outside their homes, and they often transport their mediation seats between different environments to do so. The practitioner should maintain an ideal posture that is repeatable, stable, straight and comfortable regardless of the environment. As a result, there is a need for mediation seats that are lightweight, compact, easy to transport, and suitable for indoor or outdoor use.

BRIEF SUMMARY OF THE INVENTION

Disclosed herein is a meditation apparatus comprising a meditation seat and articulated pad that is lightweight, compact, easy to transport, and suitable for indoor or outdoor use, wherein the articulated pad is pivotally connected to the seat. In some embodiments, the apparatus is capable of collapsing into a substantially rectangular solid conformation. In certain embodiments, the articulated pad comprises a first fastener positioned to mate with a second fastener on the seat when the apparatus is collapsed into the substantially rectangular solid conformation and/or the second fastener is positioned on a side face of the seat, a back face of the seat, a front face of the seat, or a bottom face of the seat.

In some embodiments of the invention, the seat comprises a base and a cushion disposed on the base. The base may comprise a top face of the base that slopes downwardly toward a front face of the seat. The base may also comprise a base material substantially capable of withstanding deformation when an adult human is seated on the seat. The cushion may comprise a cushion material capable of deformation when an adult human is seated on the seat. The cushion may also comprise a top face of the cushion that slopes downwardly relative to the bottom face of the seat toward the front face of the seat when an adult human is seated on the seat. In some embodiments, the cushion comprises an underlayer of the cushion and an upper layer of the cushion and the underlayer comprises an underlayer material and the upper layer comprises an upper layer material that is different from the underlayer material. In certain embodiments, the underlayer material has a lower compression resistance than the upper layer material. In some embodiments, the underlayer material and the upper layer material have a lower compression resistance than the base material. In some embodiments, the underlayer has a form substantially similar to a triangular prism. In particular embodiments, the front face of the seat comprises a face of the prism and the back face of the seat comprises an edge of the prism. In some embodiments, the seat comprises a heel recess. In some embodiments, the pad is detachable from the base. When the pad is detachable, the seat and the pad may comprise complementary fasteners for attaching and detaching the seat to the pad.

In some embodiments, the seat comprises a bottom face, a front face, and a bottom-front edge formed from the intersection of the bottom face and the front face, and the articulated pad comprises a center-proximal pad, a right-proximal pad, a left-proximal pad, a center-distal pad, a right-distal pad, and a left-distal pad. The center-proximal pad may be pivotally connected with the bottom-front edge of the seat and the center-distal pad along opposing edges of the center-proximal pad and pivotally connected with the right-proximal pad and left-proximal pad along opposing edges of the center-proximal pad. The center-distal pad may be pivotally connected with the right-distal pad and the left-distal pad along opposing edges of the center-distal pad. In certain embodiments, the center-proximal pad substantially conforms to the size and shape of the front face of the seat. In certain embodiments, the center-distal pad substantially conforms to the size and shape of the front face of the seat.

In particular embodiments, the articulated pad further comprises a center-outer pad, a right-outer pad, and a left-outer pad. The center-distal pad may be pivotally connected to the center-outer pad along an edge opposing the pivotal connection with the center-proximal pad and/or the center-outer pad may be pivotally connected to the right-outer pad and the left-outer pad along opposing edges of the center-outer pad.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention.

DETAILED DESCRIPTION OF THE INVENTION

Figure 1A:
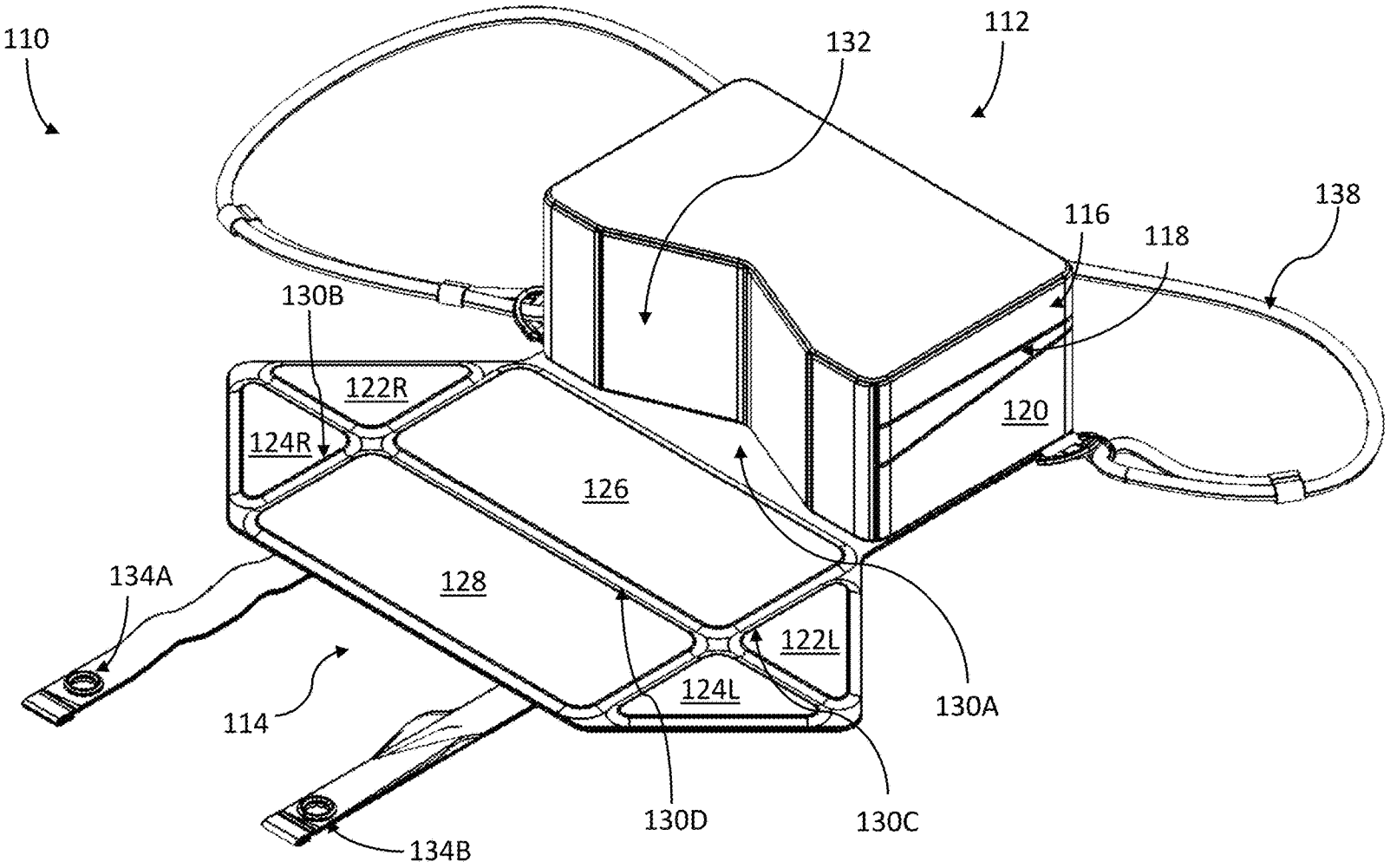
FIGS. 1A-1D show perspective illustrations of a meditation seat and articulated pad in an open configuration. The seat is shown from a front perspective (FIG. 1A), a top perspective (FIG. 1B), a right perspective (FIG. 1C), and a rear perspective (FIG. 1D).
Figure 1B:
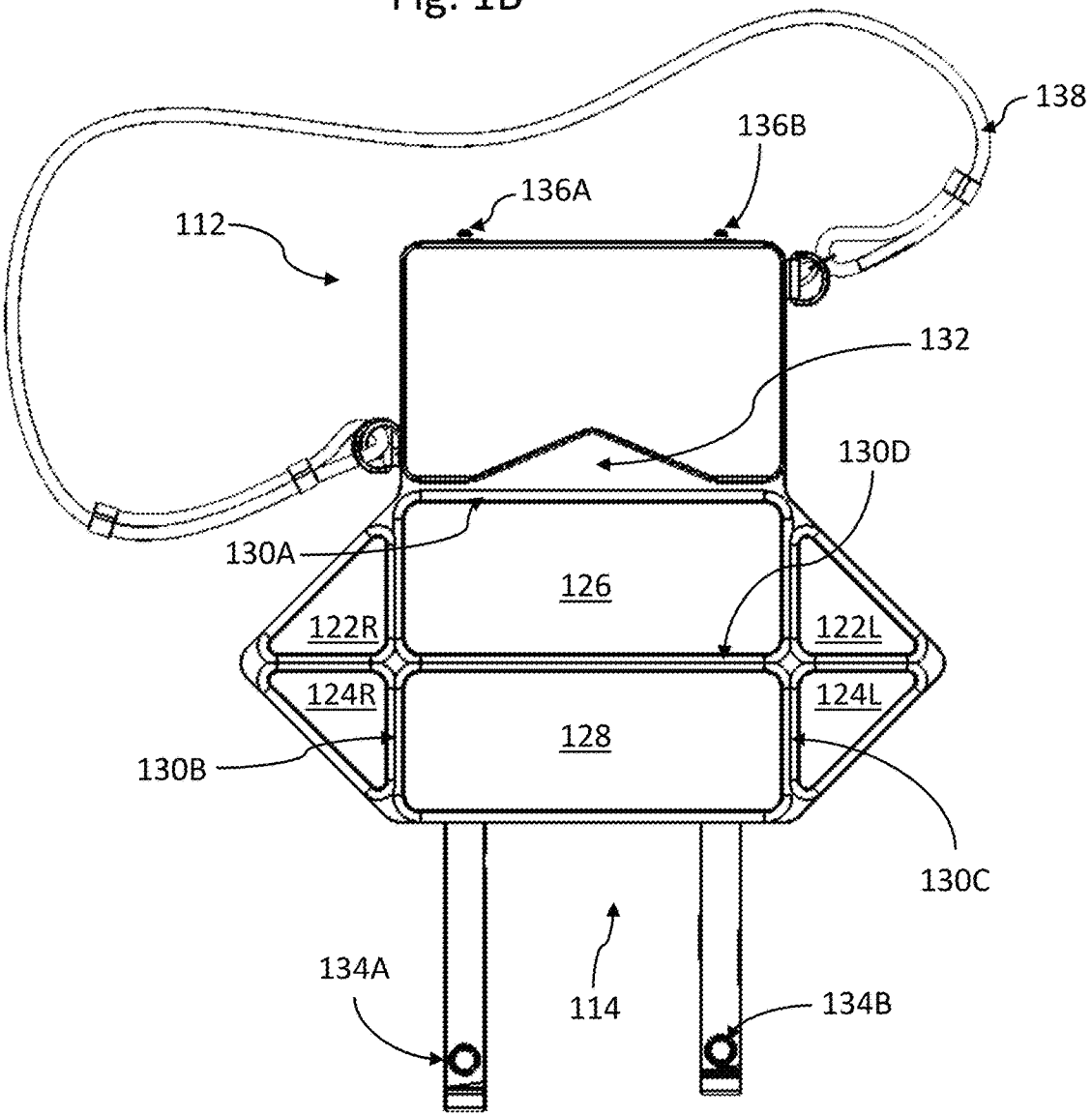

Disclosed herein is a meditation apparatus comprising a meditation seat and articulated pad that is lightweight, compact, and easy to transport that is suitable for indoor and outdoor use. The articulated pad is suitable for use over indoor and outdoor surfaces. The technology described herein provides a number of advantages or improvements over the other mediation seats. The seat provides a resting surface downwardly angled for better pelvic tilt, reduced pressure on the user while seated, and improved circulation.

The apparatus is lightweight compact, and the pad folds tightly around the seat for improved portability. The pad conforms to minor variations in the evenness of the surface, provides cushioning from hard surfaces, and insulates the user from the temperature of the surface, making it suitable for outdoor as well as indoor use. The apparatus may also provide for points of attachments, carrying straps, or carrying sacks to facilitate its attachment to a backpack, luggage, or bicycle.

As shown in FIG. 1A-1D, the apparatus 110 comprises a seat 112 and articulated pad 114. An "articulated pad" means that the pad comprises two or more sections of the pad connected by a flexible joint. The seat 112 comprises a bottom face (not labeled) that rests on the ground, the floor, or any other suitable surface for meditation. The seat 112 also comprises a front face (not labeled) that faces the pad. At the intersection of the bottom and front faces of the seat 112 is a bottom-front edge 130A, the articulated pad 114 is pivotally connected to the seat along the bottom-front edge 130A of the seat, The mechanism for pivotable connection may be one or more hinges running along the entirety of the bottom-front edge 130A or any portion or portions thereof.

As used herein, "hinge" means any jointed or flexible device on which a component may pivot. In some embodiments, a hinge may allow for almost a 360° change in relative angle. Suitably, the hinge may also allow for a 270°, 180°, or 90° change in relative angle.

The articulated pad 114 comprises several pad sections: a center-proximal pad 126, a right-proximal pad 122R, a left-proximal pad 122L, center-distal pad 128, a right-distal pad 124R, and a left-distal pad 124L. The center-proximal pad 126 is pivotally connected with the seat 112 via the bottom-front edge 130A and the center-distal pad 128 along opposing edges 130A and 130D of the center-proximal pad. The center-proximal pad 126 is also pivotally connected with the right-proximal pad 122R via edge 130B and the left-proximal pad 122L along opposing edge 130C. The center-distal pad 128 is also pivotally connected with the right-distal pad 124R via edge 130B and the left-distal pad 124L via opposing edge 130C. Each of the pivotable connections may be one or more hinges running along the entirety of edges 130B, 130C, 130D, or any portion or portions thereof. Notably, the right-proximal pad 122R and right-distal pad 124R are pivotally connected via 130D and the left-proximal pad 122L and left-distal pad 124L are pivotally connected via edge 130D.

In some embodiments, the pad may comprise an outer row of pad sections. When the pad comprises an outer row of pad sections, the pad may further comprise a center-outer pad, a right-outer-pad, and a left outer pad. The center-distal pad may be pivotally connected to the center-outer pad along an edge opposing the pivotal connection with the center-proximal pad. The center-outer pad may also be pivotally connected to the right-outer pad and the left-outer pad along opposing edges of the center-outer pad.

In some embodiments, the articulated pad 114 may be detachable. When the pad 114 is detachable, the seat 112 and pad 114 may comprise one or more fasteners for securing the pad to the seat. The term "fastener" means any device capable of securing one thing to another on its own or in combination with a mate. Fasteners may be electromagnetic or mechanical. Examples of electromagnetic fasteners include, but are not limited to, magnets and/or ferromagnetic materials such as iron. Examples of mechanical fasteners include, but are not limited to, buttons, buttonholes, toggles, loops, snaps, zippers, clasps, eyes, hooks, pins, velcro, and other suitable fasteners. In other embodiments, the pad 114 is not detachable from the seat 112.

In some embodiments of the invention, the seat 112 comprises a heel recess 132. The recess is suitably large enough to accommodate one or both heels or feet of a user seated on the seat 112 in a cross-legged pose or position. Suitably, the cross-legged pose is a Burmese style pose or a half-lotus pose.

Figure 1C:
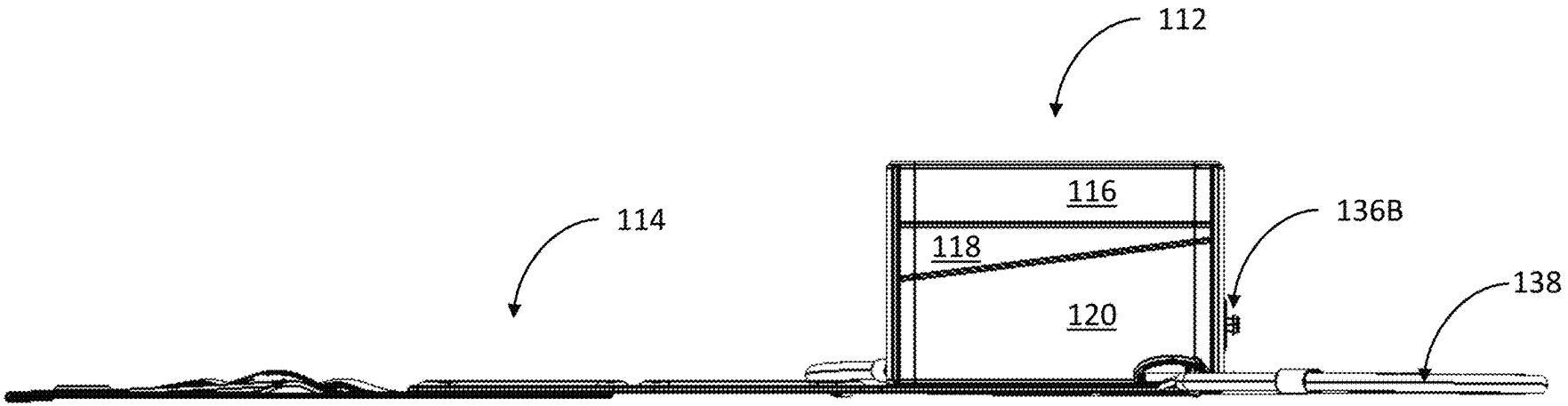
Figure 1D:
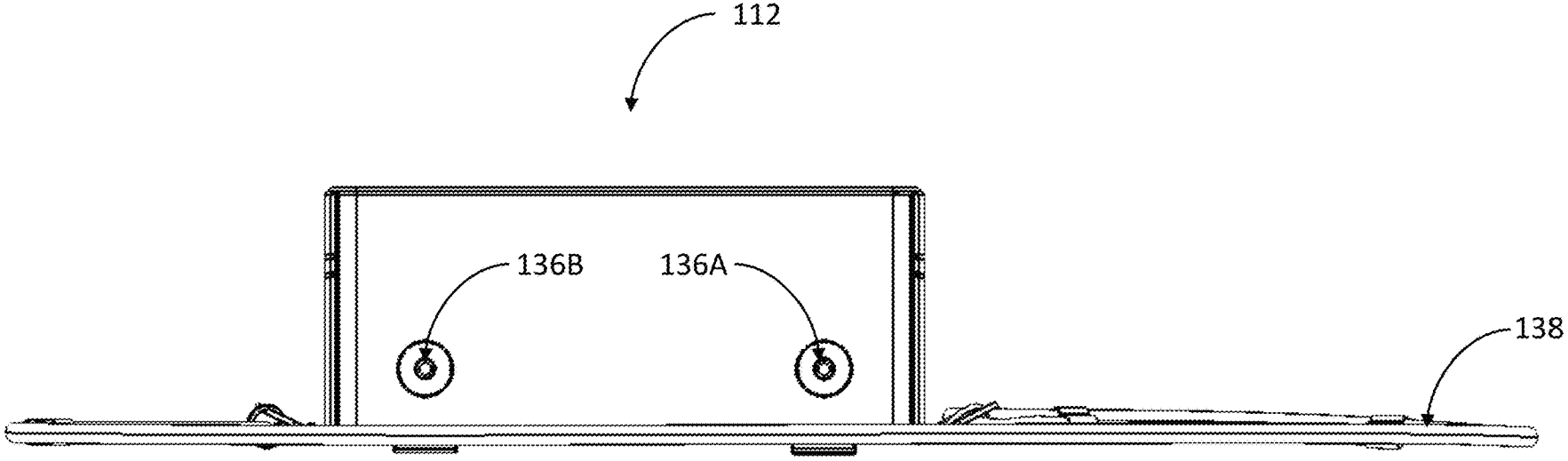
Figure 2A:
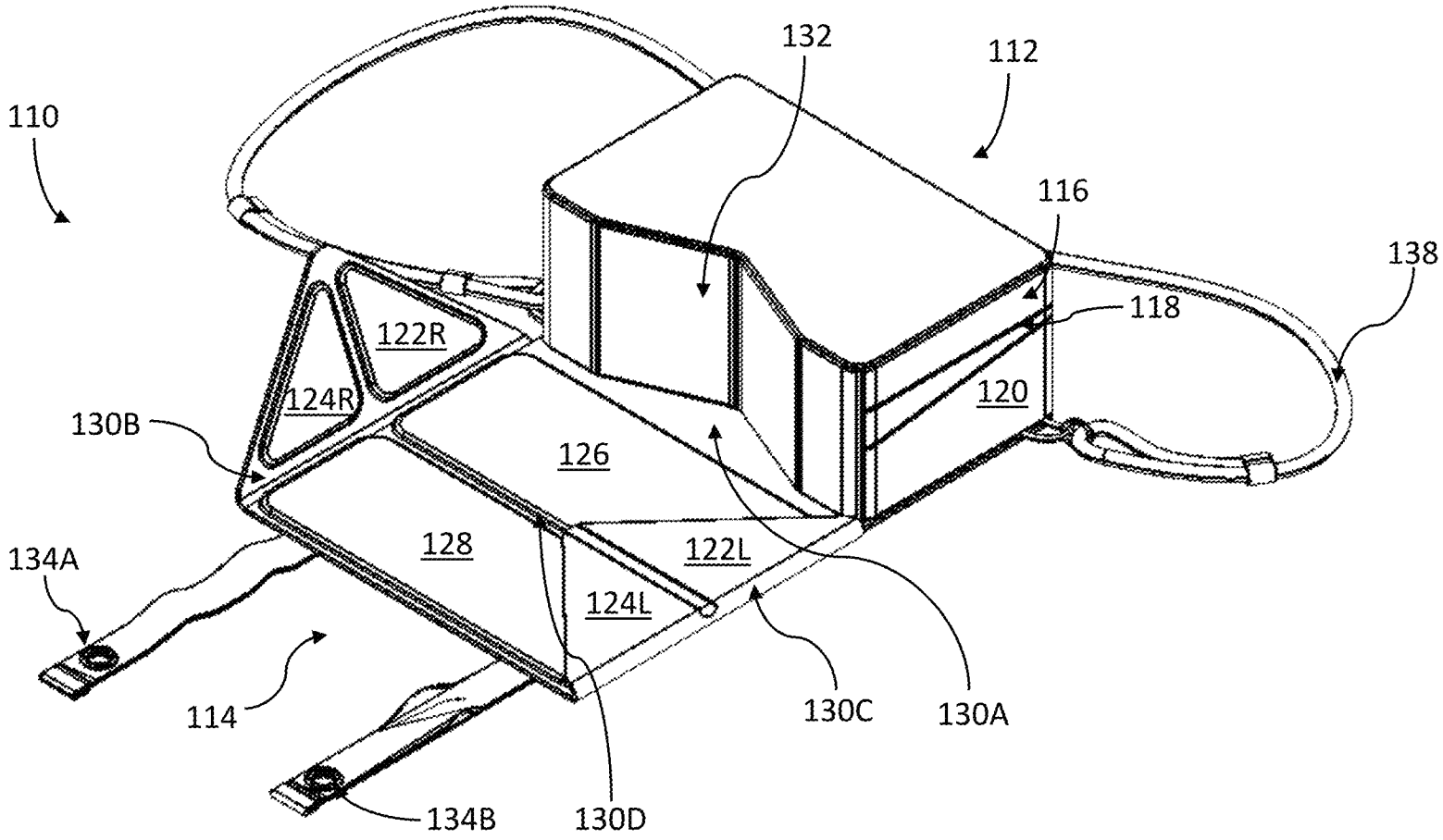
FIGS. 2A-2D show perspective illustrations of a meditation seat and articulated pad in a partially closed configuration. The seat is shown from a front perspective (FIG. 2A), a top perspective (FIG. 2B), a right perspective (FIG. 2C), and a rear perspective (FIG. 2D).
Figure 2B:
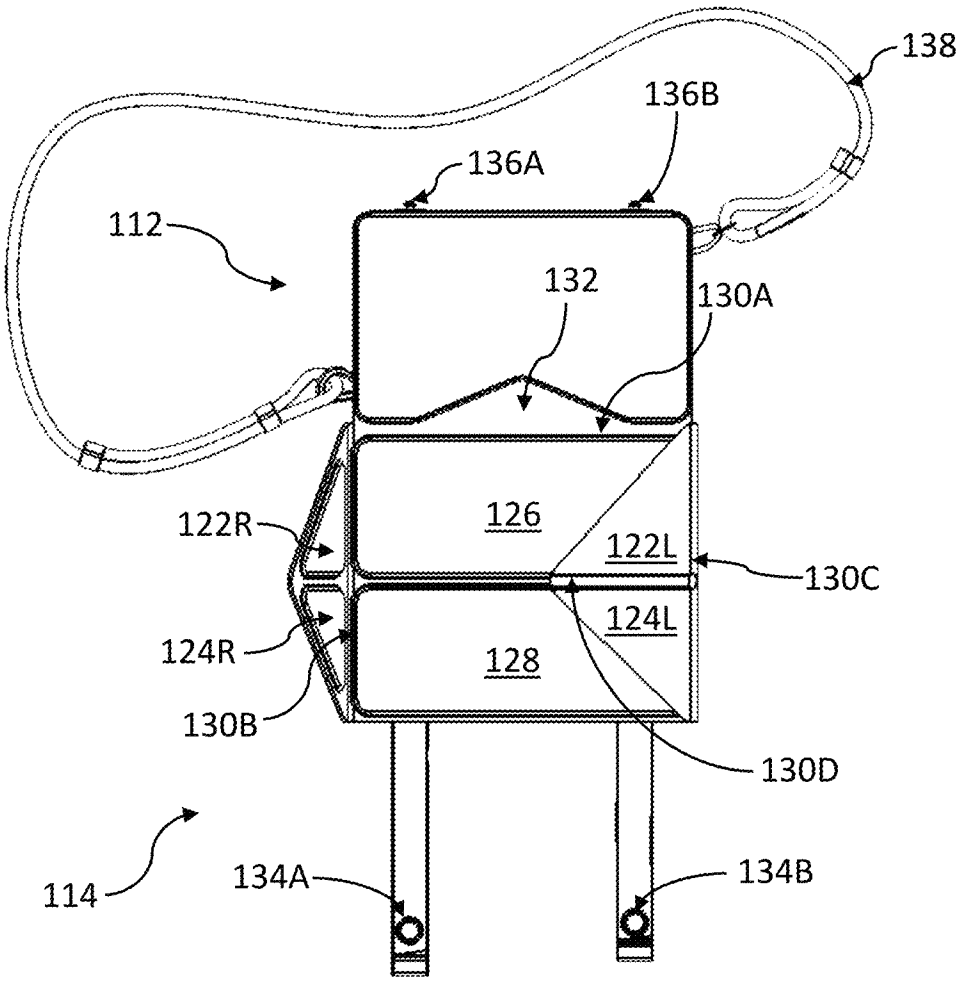
Figure 2C:
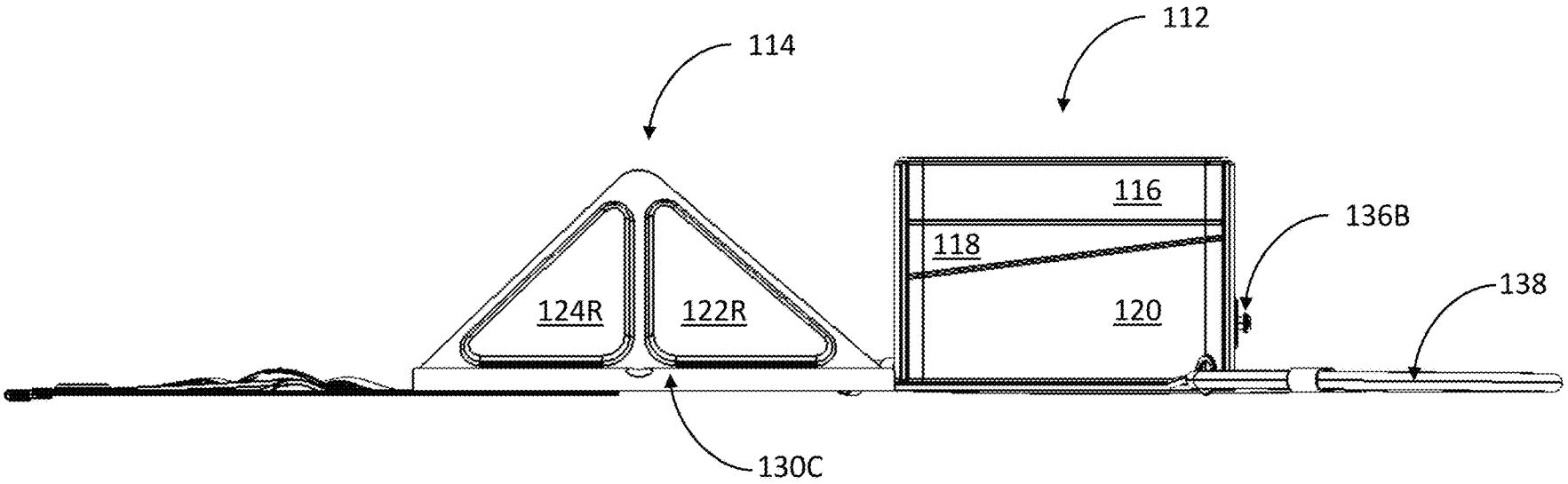
Figure 2D:
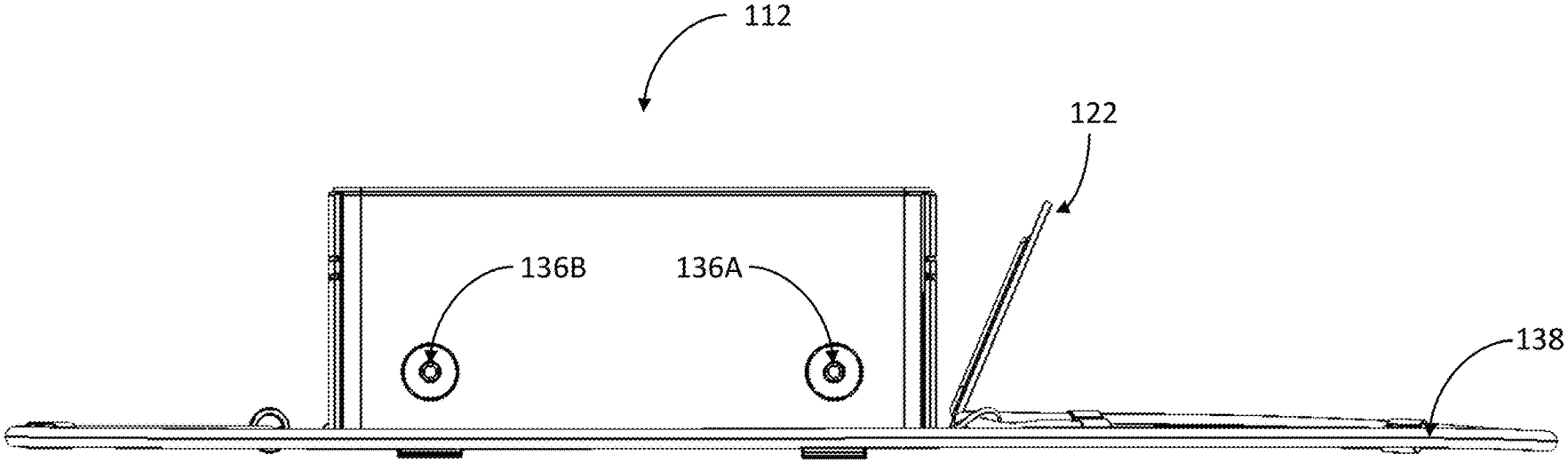
Figure 3A:
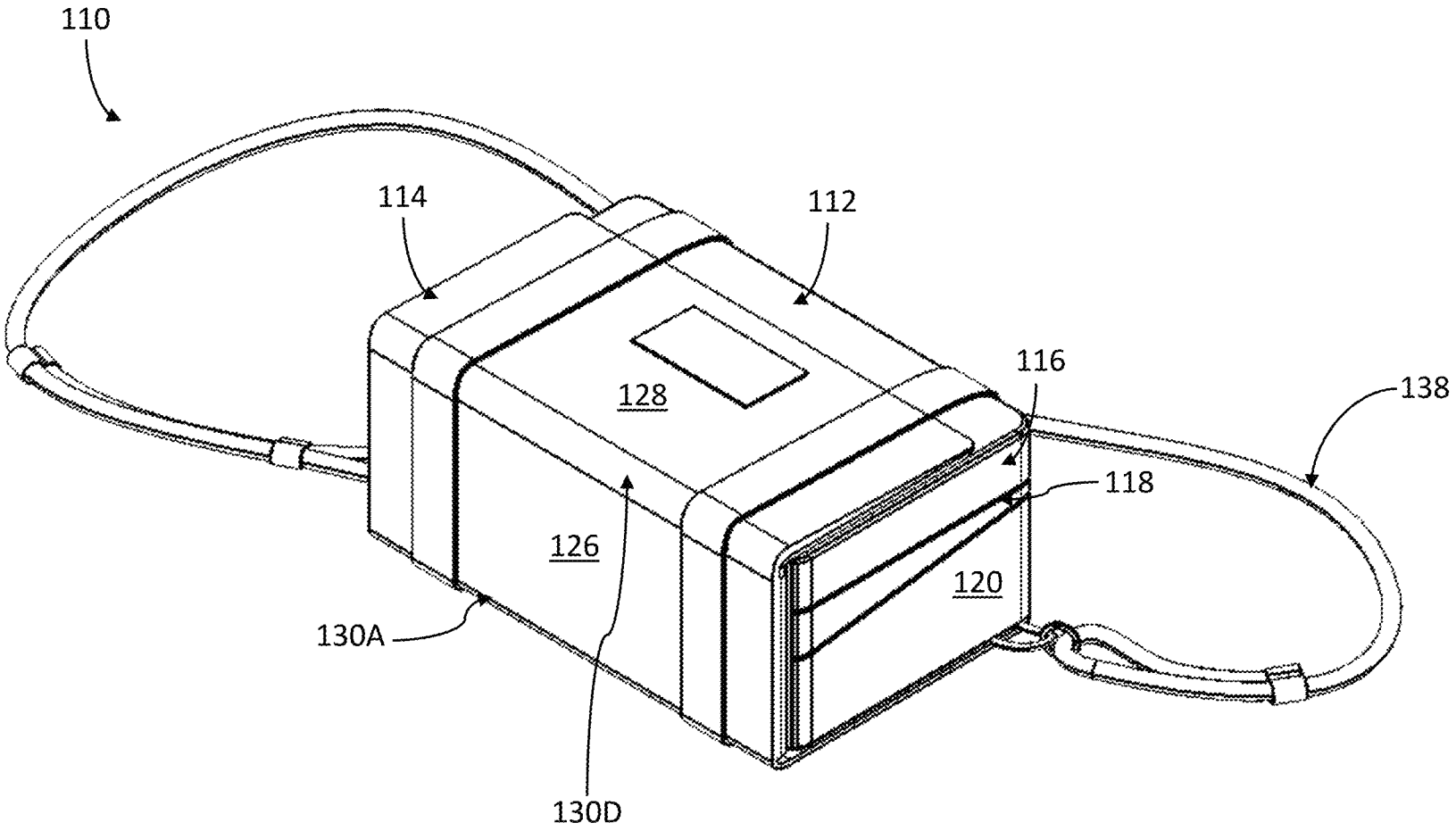
FIGS. 3A-3D show perspective illustrations of a meditation seat and articulated pad in a closed configuration. The seat is shown from a front perspective (FIG. 3A), a top perspective (FIG. 3B), a right perspective (FIG. 3C), and a rear perspective (FIG. 3D).
Figure 3B:
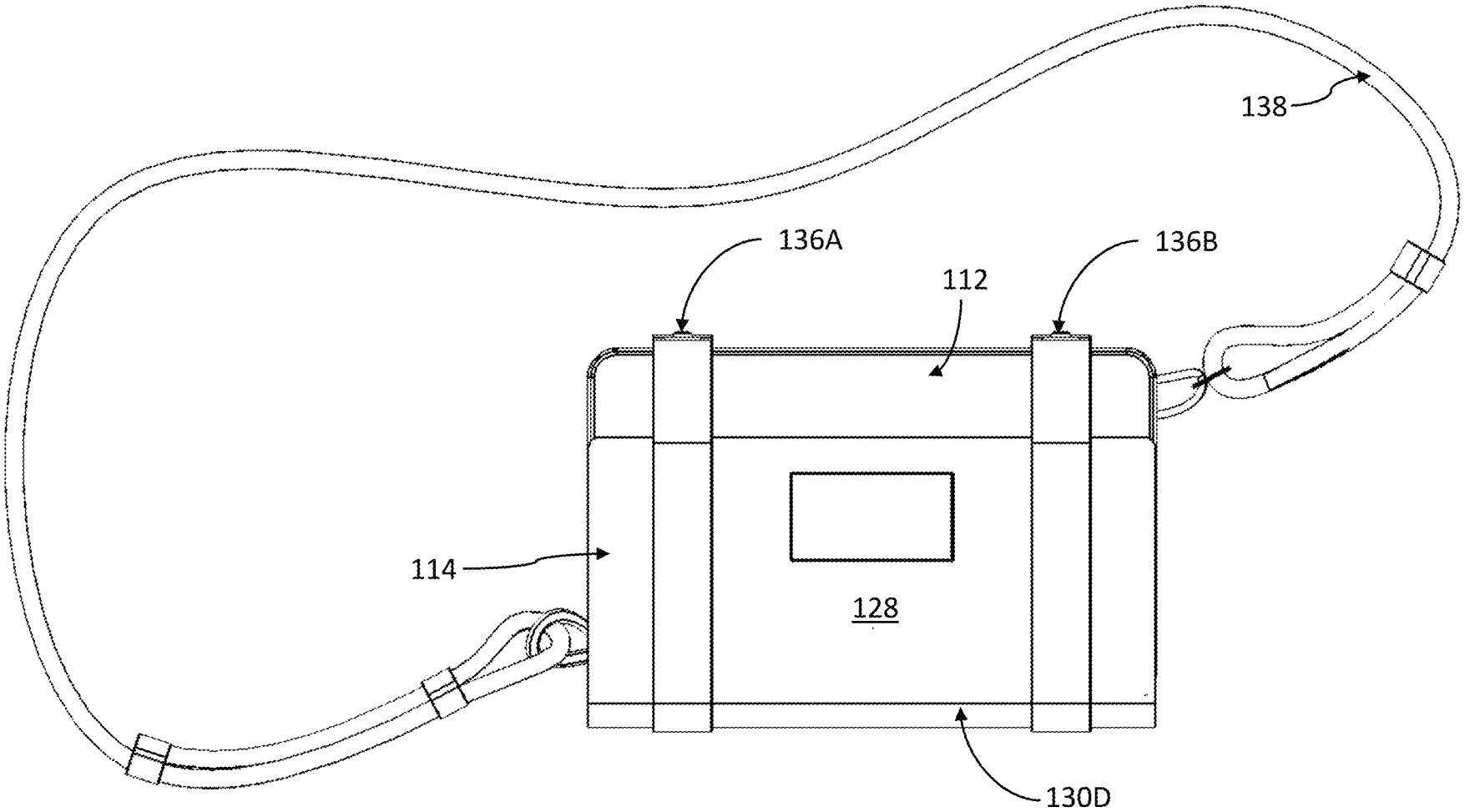
Figure 3C:
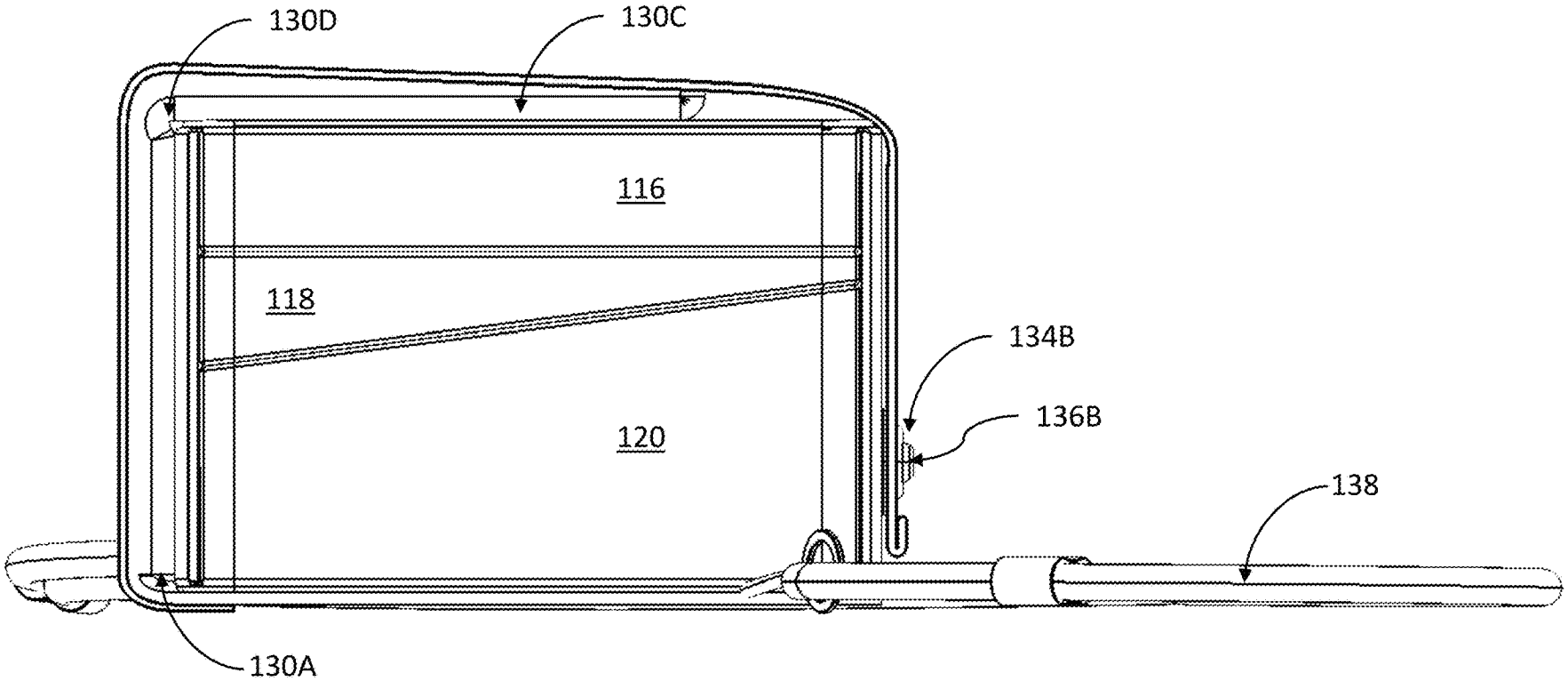
Figure 3D:
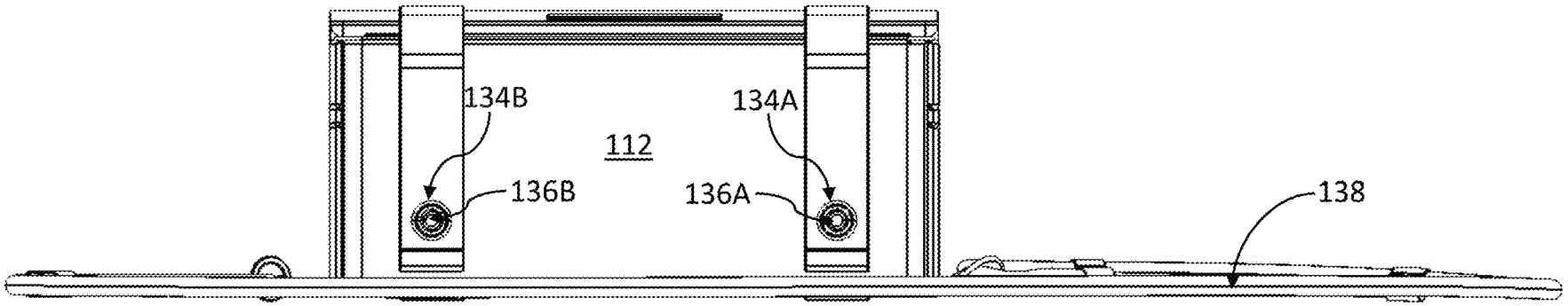

In some embodiments, the seat 112 comprises a base 120 and a cushion. The base 120 comprises a top face (not labeled), and the bottom face of the cushion (not labeled) is disposed on the top face of the base 120. As shown in FIG. 1C, the top face of the base may slope downwardly relative to the bottom face of the seat 112 toward the front face of the seat. The base may be prepared of any suitable material, but preferably is lightweight and/or substantially capable of withstanding deformation with a user is seated on the seat to provide a solid foundation for the user. As used herein, a base is substantially capable of withstanding deformation when the base compresses by less than 10%, 8%, 6%, 4%, 2%, or 1% when a force is applied by a user seated on the seat. The user may be an adult, adolescent, school-age, or preschool human. Exemplary base materials include, but are not limited to, natural materials such as cotton, wool, feather, kapok, buckwheat or other hulls, synthetic materials such as open- or closed-cell foams, polyester fill, polystyrene fill or combinations thereof. Suitably the base is substantially capable of withstanding deformation when 50 lbs, 75 lbs, 100 lbs, 125 lbs, 150 lbs, 175 lbs, 200 lbs, or more than 200 points is applied to the base.

As also shown in FIG. 1C, the bottom face of the cushion may slope downwardly relative to the bottom face of the seat 112 toward the front face of the seat. The cushion may be prepared of any suitable material, but preferably is lightweight and/or capable of deformation when an adult, adolescent, school-age, or preschool human is seated on the seat to provide a self-adjusting foundation for the user. As used herein, a cushion is capable of deformation when the base compresses by more than 2%, 4%, 6%, 8%, 10%, or more than 10% when a force is applied by a user seated on the seat. Exemplary cushion materials include, but are not limited to, natural materials such as cotton, wool, feather, kapok, buckwheat or other hulls, synthetic materials such as open- or closed-cell foams, polyester fill, polystyrene fill or combinations thereof. When the cushion material is capable of deformation and the base material is substantially capable of withstanding deformation when the user is seated on the seat 112, the top face of the cushion may self-adjust to slope downwardly relative to bottom face of the seat 112 toward the front face of the seat when the user is seated on the seat. When the seat 112 self-adjusts in this manner, the seat forms a sloped surface that provides for improved pelvic tilt, improved circulation, and a reduction in pressure felt by the user along the front of the seat 112. This advantageously allows for the seat to be used for a long period of time by the user during meditation.

As shown in FIG. 1C, the cushion may be comprised of an underlayer 118 of the cushion and an upper layer 116 of the cushion. The upper layer 116 and underlayer 118 may comprise two different cushion materials, the upper layer material and the underlayer material, respectively. In some embodiments, the underlayer material has a lower compression resistance than the upper layer material. In certain embodiments, both the underlayer material and the upper layer material have a lower compression resistance than the base material. Exemplary upper layer materials include, but are not limited to, natural materials such as cotton, wool, feather, kapok, buckwheat or other hulls, synthetic materials such as open- or closed-cell foams, polyester fill, polystyrene fill or combinations thereof. Exemplary underlayer materials include, but are not limited to, natural materials such as cotton, wool, feather, kapok, buckwheat or other hulls, synthetic materials such as open- or closed-cell foams, polyester fill, polystyrene fill or combinations thereof.

The underlayer 118 may be wedge-shaped or have a substantially triangular prism form. The underlayer 118 of the cushion is composed of a material having a lower compression resistance than either the material of the upper layer of the cushion 116 or the base 120, weight supplied by a user in the seated position will be transferred through the upper layer 116 to the underlayer 118 and may cause the underlayer 118 to substantially deform across the entire front face of the seat. Deformation by the underlayer 118 of this sort, allows the upper layer 116 to more uniformly slope downwardly toward the front face of the seat 112, automatically adjusting the top face of the seat into a sloped surface that provides the advantages described above. A face of the underlayer may comprise a portion of the front face of the seat. An opposing edge of the underlay may comprise a portion of the back face of the seat.

FIG. 2A-2D illustrate the operation of collapsing a meditation apparatus comprising a seat and an articulated pad from the open-state, shown in FIG. 1A-1D, towards its folded-state, shown in FIG. 3A-3D. FIG. 2A-2D illustrate the apparatus 110 in a partially closed configuration where pad sections 122L and 124L are resting over sections 126 and 128, respectively. Pad sections 122R and 124R are illustrated at an intermediate position, transitioning from the open-configuration shown in FIGS. 1A-1D to resting over sections 126 and 128, respectively.

FIG. 3A-3D illustrate the apparatus 110 in its folded-state or closed-configuration, having a substantially rectangular solid conformation. After the right (122R and 124R) and left (122L and 124L) pad sections are positioned over sections 126 and 128, the pad sections may be pivoted about edges 130A and 130D to engage the front and top faces of the seat 112. The apparatus 110 may be secured by mating fasteners 134A and 134B, which are connected to the articulated pad 114 via straps, to fasteners 136A and 136B positioned on the back-face of the seat 112, respectively. Also shown in FIG. 3A-3D is a carrying device 138 that allows for the apparatus 110 to be positioned over a shoulder of a person carrying the apparatus.

In other embodiments, the meditation apparatus is secured with a carrying device, such as a strap. In certain embodiments, a strap secures the apparatus across the bottom face of the seat as well the right-, center, and left-distal pads, but a strap may be oriented in any other direction, e.g., the bottom face of the seat, the back face of the seat, center-distal pad, and center-proximal pad. Other carrying devices may suitably be used, e.g., sacks, nets, pouches. The carrying device may comprise one or more additional connectors, such as a clasp attached to the strap, capable of attaching the apparatus to another object like a bicycle, backpack, or luggage.

To adopt a substantially rectangular solid conformation, the exposed faces of the seat or pad sections of the apparatus in the folded state may be substantially rectilinear in comparison to any intersecting exposed face or pad. In addition, various pads and/or faces may be substantially conforming in size and shape. Examples of pads and faces substantially conforming include, without limitation, the center-proximal pad substantially conforming to the size and shape of the front face of the seat and the center-distal pad substantially conforming to the size and shape of the top face of the seat, or any combination thereof.

In some embodiments of the invention, the pad comprises one or more fasteners along the periphery of the pad. Fasteners long the periphery of the pad may be used to connect additional pads so that the padded area can be enlarged.

The seat and pad may be covered by any suitable covering material. In some embodiments, the covering material is a fabric or textile. Suitable materials include, but are not limited to, natural materials such as cotton, hemp, wool, linen, silk, or combinations or blends thereof or synthetic materials such as polyesters, nylons, acrylics, olefins, or combinations or blends thereof. In certain embodiments, the seat comprises a covering on the bottom face of the seat that is different from the top and/or side face of the seat and/or the pad comprises a covering on the bottom face of the pad that is different from the top of the pad. For some uses, the covering may be selected for outdoor use. For outdoor uses, selecting a covering material that is water-resistant, abrasion-resistant, puncture-resistant, and/or easily cleaned may be preferred.

Unless otherwise specified or indicated by context, the terms "a", "an", and "the" mean "one or more." For example, "a molecule" should be interpreted to mean "one or more molecules."

As used herein, "about", "approximately," "substantially," and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus ≤10% of the particular term and "substantially" and "significantly" will mean plus or minus >10% of the particular term.

As used herein, the terms "include" and "including" have the same meaning as the terms "comprise" and "comprising." The terms "comprise" and "comprising" should be interpreted as being "open" transitional terms that permit the inclusion of additional components further to those components recited in the claims. The terms "consist" and "consisting of" should be interpreted as being "closed" transitional terms that do not permit the inclusion of additional components other than the components recited in the claims. The term "consisting essentially of" should be interpreted to be partially closed and allowing the inclusion only of additional components that do not fundamentally alter the nature of the claimed subject matter.

All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

All references, including publications, patent applications, and patents, cited herein are hereby incorporated by reference to the same extent as if each reference were individually and specifically indicated to be incorporated by reference and were set forth in its entirety herein.

Preferred aspects of this invention are described herein, including the best mode known to the inventors for carrying out the invention. Variations of those preferred aspects may become apparent to those of ordinary skill in the art upon reading the foregoing description. The inventors expect a person having ordinary skill in the art to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A meditation apparatus comprising a seat and an articulated pad pivotally connected to the seat, wherein the seat comprises a bottom face, a front face, and a bottom-front edge formed from the intersection of the bottom face and the front face; and wherein the articulated pad comprises a center-proximal pad, a right-proximal pad, a left-proximal pad, center-distal pad, a right-distal pad, and a left-distal pad; and wherein the center-proximal pad is pivotally connected with the bottom-front edge of the seat and the center-distal pad along opposing edges of the center-proximal pad; and wherein the center-proximal pad is pivotally connected with the right-proximal pad and left-proximal pad along opposing edges of the center-proximal pad; and wherein the center-distal pad is pivotally connected with the right-distal pad and the left-distal pad along opposing edges of the center-distal pad.

2. The apparatus of claim 1, wherein the seat comprises a base and a cushion disposed on the base.

3. The apparatus of claim 2, wherein the base comprises a top face of the base that slopes downwardly toward a front face of the seat.

4. The apparatus of claim 2, wherein the base is substantially capable of withstanding deformation when an adult human is seated on the seat.

5. The apparatus of claim 2, wherein the cushion is capable of deformation when an adult human is seated on the seat.

6. The apparatus of claim 2, wherein a top face of the cushion slopes downwardly relative to the bottom face of the seat toward the front face of the seat when an adult human is seated on the seat.

7. The apparatus of claim 2, wherein the cushion comprises an underlayer and an upper layer, and wherein the underlayer comprises a different material from the upper layer material.

8. The apparatus of claim 7, wherein the underlayer has a lower compression resistance than the upper layer.

9. The apparatus of claim 8, wherein the underlayer and the upper layer have a lower compression resistance than the base.

10. The apparatus of claim 1, wherein the seat comprises a heel recess.

11. The apparatus of claim 1, wherein the pad is detachable from the base.

12. The apparatus of the claim 11, wherein the pad is attached with a fastener.

13. The apparatus of claim 1, wherein the center-proximal pad substantially conforms to the size and shape of the front face of the seat.

14. The apparatus of claim 1, wherein the center-distal pad substantially conforms to the size and shape of the front face of the seat.

15. The apparatus of claim 1, wherein the apparatus is capable of collapsing into a substantially rectangular solid conformation.

16. The apparatus of claim 15, wherein the articulated pad comprises a first fastener positioned to mate with a second fastener on the seat when the apparatus is collapsed into the substantially rectangular solid conformation.

17. The apparatus of claim 16, wherein the second fastener is positioned on a side face of the seat, a back fact of the seat, a front face of the seat, or a bottom face of the seat.

18. The apparatus of claim 1, wherein the articulated pad further comprises a center-outer pad, a right-outer pad, and a left-outer pad; and wherein the center-distal pad is pivotally connected to the center-outer pad along an edge opposing the pivotal connection with the center-proximal pad; and wherein the center-outer pad is pivotally connected to the right-outer pad and the left-outer pad along opposing edges of the center-outer pad.

19. A meditation apparatus comprising (a) a seat comprising a base, the base comprising a top face that slopes downwardly toward a front face of the seat, and a cushion, the cushion comprising a wedge-shaped underlayer and an upper layer of the cushion, disposed on the base, and (b) an articulated pad pivotally connected to the seat, wherein the underlayer and the upper layer have a lower compression resistance than the base.

20. The apparatus of claim 19, wherein the apparatus is capable of collapsing into a substantially rectangular solid conformation.

21. The apparatus of claim 19, wherein the seat comprises a heel recess.

22. The apparatus of claim 19, wherein the pad is detachable from the base.

23. The apparatus of claim 19, wherein the seat comprises a bottom face, a front face, and a bottom-front edge formed from the intersection of the bottom face and the front face; and wherein the articulated pad comprises a center-proximal pad, a right-proximal pad, a left-proximal pad, center-distal pad, a right-distal pad, and a left-distal pad; and wherein the center-proximal pad is pivotally connected with the bottom-front edge of the seat and the center-distal pad along opposing edges of the center-proximal pad; and wherein the center-proximal pad is pivotally connected with the right-proximal pad and left-proximal pad along opposing edges of the center-proximal pad; and wherein the center-distal pad is pivotally connected with the right-distal pad and the left-distal pad along opposing edges of the center-distal pad.

24. The apparatus of claim 23, wherein the apparatus is capable of collapsing into a substantially rectangular solid conformation.

25. A meditation apparatus comprising a seat and an articulated pad pivotally connected to the seat, wherein the apparatus is capable of collapsing into a substantially rectangular solid conformation.

26. The apparatus of claim 25, wherein the seat comprises a base, the base comprising a top face that slopes downwardly toward a front face of the seat, and a cushion, the cushion comprising a wedge-shaped underlayer and an upper layer of the cushion, disposed on the base.

27. The apparatus of claim 26, wherein the underlayer and the upper layer have a lower compression resistance than the base.

28. The apparatus of claim 25, wherein the seat comprises a heel recess.

29. The apparatus of claim 25, wherein the pad is detachable from the base.

30. The apparatus of claim 25, wherein the seat comprises a bottom face, a front face, and a bottom-front edge formed from the intersection of the bottom face and the front face; and wherein the articulated pad comprises a center-proximal pad, a right-proximal pad, a left-proximal pad, center-distal pad, a right-distal pad, and a left-distal pad; and wherein the center-proximal pad is pivotally connected with the bottom-front edge of the seat and the center-distal pad along opposing edges of the center-proximal pad; and wherein the center-proximal pad is pivotally connected with the right-proximal pad and left-proximal pad along opposing edges of the center-proximal pad; and wherein the center-distal pad is pivotally connected with the right-distal pad and the left-distal pad along opposing edges of the center-distal pad.

31. The apparatus of claim 25, wherein the articulated pad comprises a first fastener positioned to mate with a second fastener on the seat when the apparatus is collapsed into the substantially rectangular solid conformation.

* * * * *